United States Patent [19]

Mauro

[11] Patent Number: 4,837,977

[45] Date of Patent: Jun. 13, 1989

[54] WOOD CLAD WINDOWS

[76] Inventor: Gerald D. Mauro, 135 Springhouse La., Pittsburgh, Pa. 15238

[21] Appl. No.: 274,981

[22] Filed: Nov. 22, 1988

Related U.S. Application Data

[63] Continuation of Ser. No. 211,873, Jun. 27, 1988, abandoned.

[51] Int. Cl.[4] ..... E06B 3/00

[52] U.S. Cl. ..... 49/501; 49/504; 52/507

[58] Field of Search ..... 49/501, 503, 504, 505, 49/506, 507; 52/506, 507, 211, 631, 656, 212, 213, 716, 727, 215, DIG. 8, 455, 456

[56] References Cited

U.S. PATENT DOCUMENTS

| | | | |
|---|---|---|---|
| 2,639,472 | 5/1963 | Jonsson | 20/11 |
| 3,042,160 | 7/1962 | Price | 49/504 |
| 3,130,455 | 4/1964 | Borlenghi | 20/11 |
| 3,221,462 | 12/1965 | Pomeroy | 52/507 |
| 3,364,623 | 1/1968 | Skuar | 49/504 |
| 3,815,285 | 6/1974 | Kuyper | 49/501 |
| 3,890,754 | 6/1975 | Spurdle | 52/631 |
| 4,097,100 | 6/1978 | Sauder | 312/257 |
| 4,265,052 | 5/1981 | Johnson et al. | 49/63 |
| 4,328,644 | 5/1982 | Scott et al. | 49/501 |
| 4,341,048 | 7/1982 | Minter | 52/211 |
| 4,391,072 | 7/1983 | Moore | 52/211 |
| 4,479,331 | 10/1984 | Bertolami et al. | 49/404 |
| 4,558,536 | 12/1985 | Dunsmoor | 49/504 |
| 4,587,759 | 5/1986 | Gray | 49/501 |
| 4,590,723 | 5/1986 | Nassau et al. | 52/211 |

*Primary Examiner*—Kenneth J. Dorner
*Assistant Examiner*—Gerald A. Anderson
*Attorney, Agent, or Firm*—Banner, Birch, McKie & Beckett

[57] ABSTRACT

Wood cladding for mounting on the inner surface of nonwooden windows having common interior cross sections in which the sash is mounted on the frame from the outside of the window is disclosed. The wood cladding includes at least two sections of wood shaped to conform to the interior surface of the window. Each wood section has a uniform cross section along its entire length and is attachable to either the frame or sash of the window without altering the length and width dimensions of the window or affecting the fit of the window. Cladding may also be applied to mullions. The cladding provides an unmarred, unblemished wood appearance on the inner surface of the window. Fastening devices such as screws or dowels are used to fasten the wood sections to the window without being visible on the frame or on the sash when the sash is closed.

25 Claims, 2 Drawing Sheets

WOOD CLAD WINDOWS

This application is a continuation of application Ser. No. 211,873, filed June 27, 1988 and now abandoned.

TECHNICAL FIELD

The present invention is directed to a wood covering, or cladding, for the interior surface of a window having a metal, vinyl, or other nonwood frame assembly. More particularly, the present invention is directed to wood cladding for fixed windows or windows which open outwardly and close by the sash moving from the outside towards the inside.

BACKGROUND OF THE INVENTION

In general, most windows include both a sash and a frame. The sash is the structure in which the panes of glass are set and which forms the moveable part of the window. The frame is the fixed structure fitted within a wall opening in which the sash is placed.

Most windows are constructed entire of wood or enterily of metal, vinyl, or other nonwood material. Both wood and nonwood windows have their respective advantages and disvantages. Wood windows are generally preferred for their pleasing appearance and their ability to be painted or stained to coordinate with interior decor. Wood windows also provide superior insulation over metal and similar nonwood windows. However, wood windows generally require significantly more external maintenace than metal and other nonwood windows.

Various attempts have been made to combine the beneficial features of wood and nonwood windows. Generally, these attempts have involved putting a metal or vinyl covering or cladding on the outside of a wood window or, conversely, putting a wood cladding on the inside of a nonwood window. Considering the cladding problems inherent in window designs such as single and double hung windows, slider windows, and windows in which the sash pivots inwardly, there have been other attempts to obtain the pleasing interior appearance of a wood window by merely simulating wood grain in vinyl extrusions. These various attempts have met with limited success.

The present invention is directed to an improved wood cladding or decorative facing for the interior surfaces of a nonwood window. The invention is particularly applicable to casement, awning, and fixed windows. Because of the significant structural and operating differences between these window types and conventional double hung windows, sliding windows, and windows that swing inwardly, the present invention is not particularly suited to these latter types of windows.

Windows that slide from side to side horizontally, windows that are of the hung-type and open and close vertically, and windows that are hinged and open toward the inside of the building are usually built using a variety of different shapes and extrusions to construct the overall window unit. In these windows the sash is inserted and removed from the inside. It is very difficult to use wood cladding on the interior of these styles of windows due the nature of their operation and the close tolerances between window sections. The wood, having a minimal thickness of ¼" for structural integrity, interferes with the operation and function of the window when applied to the interior surface. This renders sliding, hung, and inwardly opening windows non-functional and inoperable with the wood attached.

One approach to providing wood cladding on the interor surface of a metal double hung window is disclosed in Dunsmoor, U.S. Pat. No. 4,558,536. However, this cladding is exceptionally complex and costly to apply and requires alteration of the wall opening to accommodate the increased window dimensions. Additionally, the wood cladding forms part of the window, i.e., the window is not a complete, functional window without the wood cladding.

Windows which open outwardly and close by the sash moving from the outside to the inside, can more readily accommodate interior wood cladding than double hung windows because the former generally have a perimeter frame which provides a uniform interior surface and cross-section. These window types are primarily casement, which pivots around a vertical axis; awning, which pivots around a horizontal axis; and fixed or picture. These three primary window styles are constructed with the sash inserted into the frame from the outside. They operate differently from typical double hung, slider, and inwardly swinging windows. This makes interior cladding with wood according to the present invention both economically feasible and practical.

Currently, virtually all windows with wood interiors and vinyl, fiberglass, or aluminum exteriors are made in common, stock sizes. Because of the close size tolerances required during window replacement projects, these windows usually fit exactly into window openings only with the use of perimeter fillers, expanders, or additional wood trim to take up the space remaining between the new window and the existing opening. The use of perimeter frame expanders and fillers is highly undesirable to the increasingly sophisticated public, who wants a custom sized window with a wood interior, and a vinyl, fiberglass, or aluminum exterior.

The design of casement, awning, and fixed windows, whether of aluminum, vinyl, or fiberglass, is substantially universal. All four sides of the frame of each window type are identical in shape and have uniform cross sections. All four sides of the operable sash sections also are identical in shape and have uniform cross sections. The frame and sash sections are miter cut at 45° and then are fastened together either mechanically with screws, chemically by heat-fusing such as welding, or with glue. This results in four sided rectangular frames and sashes of varying sizes. The only significant difference between outwardly opening casement and awning windows and fixed picture windows is in the operating hardware. The hardware includes a pair of slide hinges and a roto-gear type winder that opens and closes the window sash by turning. The picture window uses identical frame and sash sections, but does not use hinges or a gear operator. The sash simply is fixed in place, usually by screws, and does not open.

Casement and awning style windows have an offset, channel-like area located around the internal frame perimeter, in which concealed hinge-type hardware and operator arms are housed when the windows are closed. This channel keeps the hardware away from the operation of the sash and allows the window to open and close freely without interference. The hinge-type hardware and locking system are always mounted in this channel, which runs the entire perimeter of the frame.

SUMMARY OF THE INVENTION

It is an object of the present invention to provide wood cladding for the interior surface of a nonwooden outwardly opening or fixed window.

It is another object of the present invention to provide wood cladding that is easily manufactured from uniformly cross-sectioned wood and that may be retrofitted on existing windows or mounted on new windows without impairing the operation of the windows and without altering the frame size of the window.

Wood cladding or decorative facing according to the present invention mounts on the inner surface of nonwooden windows having common interior cross sections and in which the sash mounts on the frame from the outside. The wood cladding includes at least two sections of wood shaped to conform to the interior surface of the window. Each wood section has a uniform cross section along its entire length and is attachable to either the frame or sash of the window without altering the dimensions or affecting the operation of the window. As discussed below, cladding may also be applied to mullions in which case a third cross section of wood is required. The cladding provides an unmarred, unblemished wood appearance on the interior surface of the window. Fastening devices such as screws or dowels are used for fastening wood sections to the window without being visible on the frame or on the sash when the sash is closed. The wood cladding may be made by first forming two long wooden strips having uniform cross sections shaped to conform to the interior surfaces of the frame and sash of the window. Next, each long wooden strip is cut into sections having lengths conforming to the lengths of the sides of the window sash and frame. The ends of the wooden sections are beveled to form miter joints when the wooden sections are mounted on the window.

With the present invention, the windows can be manufactured to custom sizes, using current manufacturing procedures. Then the windows can be clad with wood which is shapped to conform to the interior surface of the frame and sash after the windows have been assembled. These types of windows can use standard hardware (e.g., locks and winders), without alteration, by milling out the wood cladding in the exact location where the hardware would be applied without the cladding, then inserting the hardware through the wood cut-out and fastening it directly onto the regular aluminum, fiberglass, or vinyl surface of the window frames. Only one cross-sectional shape of wood is required to clad the entire inside perimeter of the frame, and only one different cross-sectional shape of wood is required to clad the entire inside perimeter of the sash. This can only be performed with casement, awning, and fixed picture style windows because of their universal design characteristics. Thus, the present invention is intended for use primarily only with those picture windows that have profiles identical or similar to those used in outwardly swinging windows such as casement and awning windows, that is, windows wherein the sash is mounted on the frame from the outside of the window. Other types of windows, such as double hung, slider, and inwardly swinging windows would require a multitude of different wood shapes to clad their respective interiors. Even then, in all probability, the cladding would interfere with the windows— operation, thus preventing wood cladding of their interiors.

Another aspect of this invention is the application of the wood to the window frame and its fastening method. The offset channel housing the hinge and lock allows free access to the underside of the wood cladding for fastening it to the frame. By drilling a hole through the frame in this channel, and part way through the underside of the wood cladding, the wood can be securely and permanently fastened to the frame with adhesive and with screws or dowels of the proper length. The cladding of the sash can be accomplished by applying an adhesive to the underside of the wood cladding and/or drilling a hole through the clad wood and glass stop, which is a portion of the sash that receives the glass, then inserting the correct size wood dowel through the cladding and sash for added fastening. Alternately, screws may be threaded through holes in the wood cladding and sash from the outside in. The screws are located so that when the sash is closed, the clad frame covers and conceals them. On both the frame and sash cladding material, a series of grooves is milled into the underside of the wood so that the fastening adhesive may reach beyond the surface of the wood for a more secure bond between the wood and the window material.

The simplest way of fastening the wood would be to run a screw directly through the interior face of the wood and into the primary frame; the fastener head would be left exposed or countersunk into the wood and plugged. However, this method is both unattractive and undesirable. By fastening from the rear through the hardware channel area, the decorative face of the wood cladding is not penetrated by the screws. Also the 45° miter cut joints on the interior surface of the wood cladding can be aligned by tightening or loosening the fastening screws. Once the adhesive dries, the alignment of the wood surface at this miter joint is permanently maintained. Although the screw could be eliminated entirely if a super adhesive is used, clamps or weights would be required to ensure the accuracy of the miter alignment. Much more control can be exercised in assembly with the screw and glue system.

If used, muntins, horizontal and vertical division bars which divide the glass into separate smaller lights, are formed of solid wood, as is common in the wood window industry. Mullions, structural horizontal and vertical frame members which divide frames between fixed or operational individual sash sections, are generally designed so that they have features similar to those of the frame. However, mullions accept sash insertion from both sides rather than one. The mullion has an identical recess area along both sides to permit fastening of wood cladding in the same manner described above for the frame of the window. The wood shape would be milled to the same approximate shape as the interior surface of the mullion. By cladding the mullion, any combination of casement, awning, and picture windows can be obtained by using the same wood cladding.

Wood clad windows according to the present invention may be newly constructed and installed in new construction. Additionally, wood cladding according to the invention may be readily retrofitted to existing windows without structural modification to the window or the wall opening. In retrofit installations, the wood does not interfere with the critical exterior frame dimensions required when building and fitting custom sized windows into existing openings. This is because the size of the outer frame perimeter of the window is exactly that of the outer wood perimeter. Any type of wood can be used (e.g., oak, cherry walnut, pine, birch, poplar) to duplicate the remainder of the interior wood surroundings. This creates the appearance that the window and the interior wood casings are integral.

In bay or bow style windows, which project out from a building, the interior wood surface can be clad in a variety of woods to match existing head, jamb, and seat boards, while the exterior aluminum, vinyl, or fiberglass surface remains weatherproof and maintenance free. The exterior surface can be made in a variety of colors to suit the design tastes of the consumer.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

The figures illustrate wood cladding and windows in which the sash is mounted on the frame from the outside and on which the cladding may be applied. As described, the wood clading may be applied to outwardly opening windows in which the sash pivots around a vertical axis (e.g., casement windows), and to outwardly opening window in which the sash pivots around a horizontal axis (e.g., awning windows). Additionally, the cladding may be applied to fixed windows, such as picture windows, in which the sash is mounted on the frame from the outside of the window. In general, these types of windows are structurally similar and, for the pursose of this invention, are structurally and functionally the same. Thus, the invention is shown primarily with regard to outwardly opening, vertically pivoting casement windows only.

Figure 1:
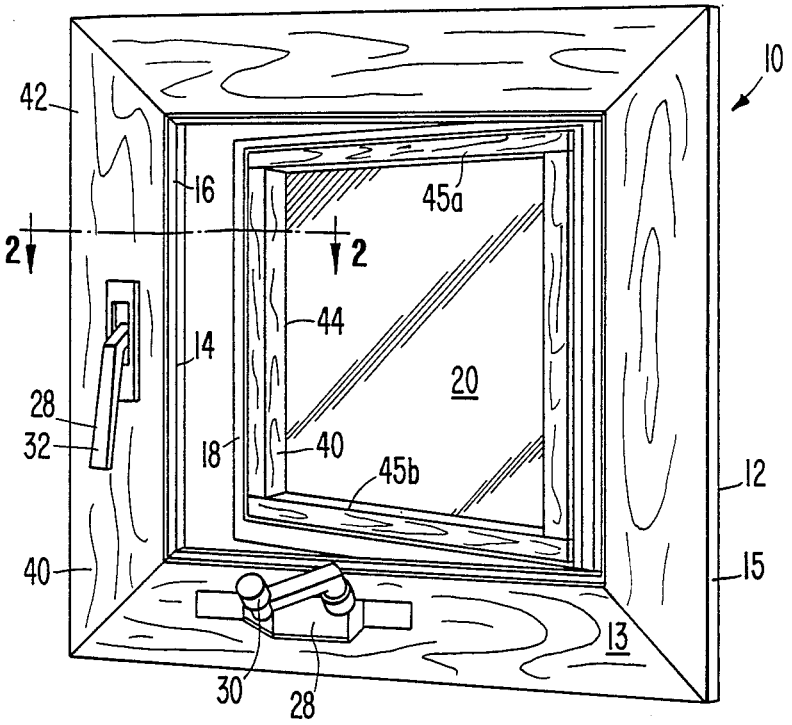
FIG. 1 is a perspective view of the interior of a wood clad window frame and sash with the sash partially open.

FIG. 1 shows a typical nonwooden window 10 after the application of wood cladding 40. Wood cladding 40 may be disposed on new windows 10 before the windows are installed, or wood cladding 40 may be retrofitted on existing windows 10. Window 10 is typically made of aluminum, fiberglass, or vinyl. Absent wood cladding 40, window 10 is a complete, functional window. Wood cladding 40 is not a required component of window 10, and it does not impede or alter the functional characteristics of window 10.

Figure 3:
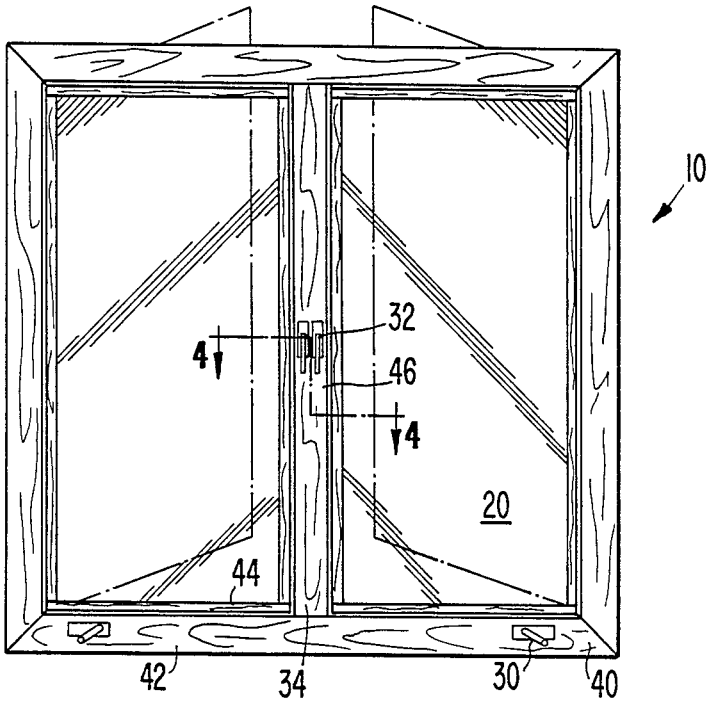
FIG. 3 is a front view of a wood clad window having two sash units separated by a mullion, with the sashes closed.
Figure 4:
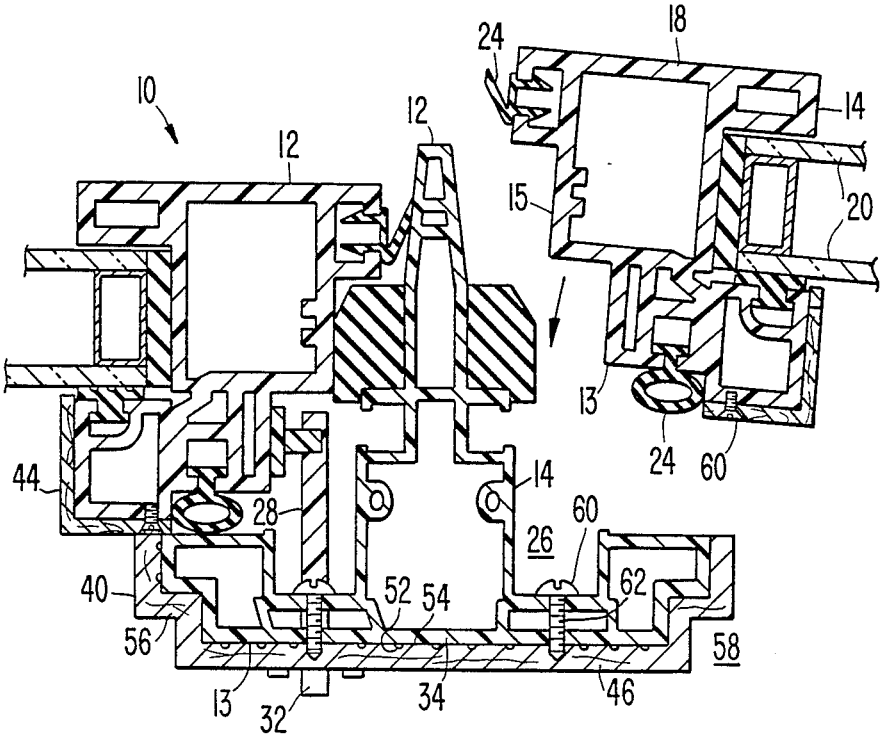
FIG. 4 is a sectional view of the wood clad window frame and sash taken along line 4—4 of FIG. 3, with one of sashes partially open.

Window 10 has outer surface 12 which faces the outside of the building structure, and inner surface 13 which faces the inside. Interior side surface 14 is disposed along the four sides of the interior of the frame of window 10 and exterior side surface 15 is disposed along the four sides of the exterior of the frame of window 10 between outer surface 12 and inner surface 13. Window 10 includes two primary components, frame 16 and sash 18. Exterior side surface 15 of frame 16 is mounted inside the wall of the building, and interior side surface 14 receives sash 18. Exterior side surface 15 sash 18 is receivable within interior side surface 14 of frame 16, and interior side surface 14 of sash 18 receives panes of glass 20. Panes of glass 20 are received within glass stop 20 of sash 18. Weatherstripping 24 is also part of sash 18. Window frame 16 is formed having channel area 26 within locking and pivoting system 28 is housed. As best shown in FIG. 4, locking and pivoting system 28 is connected at one end to sash 18 and at another end to frame 16. Locking and pivoting system 28 includes handle 30 for opening and closing sash 18, and locking lever 32 for locking closed sash 18. Where a plurality of windows 10 are disposed adjacent each other, mullions 34 separate windows 10. Mullions 34 are formed between lights of windows 10, as part of frame 16. Two locking and pivoting systems 28 are disposed within mullion 34, as best shown in FIG. 3, which illustrates two locking levers 32.

Wood cladding 40 includes three sections of wood shaped to conform to the various surfaces of interior surface 14 window 10. Frame wood cladding 42 is disposed on frame 16. Sash wood cladding 44 is disposed on sash 18. Mullion wood cladding 46 is disposed on mullion 34. Each type of wood cladding 40 has a uniform cross section along its entire length. Wood cladding 40 is constructed by forming long wooden strips of uniform cross section shaped to conform to the respective interior surfaces of window 10. Each wooden strip is then cut into sections having lengths conforming to the lengths of the sides of window 10. Four lengths of wood cladding 40 are disposed along the four sides of various portions of window 10. The four portions of frame wood cladding 42 join at miter joints at each corner of frame 16.

Frame wood cladding 42 includes body portion 48 which fits against the inner planar surface of frame 16. Retaining lip 50 is formed at one end of body portion 48, is substantially perpendicular to body portion 48, and fits around the outer peripheral edge of the inner planar surface of frame 16. Where handle 30 and locking lever 32 of locking and pivoting system 28 protrude from frame 16, body portion 48 of frame wood cladding 42 has openings milled therein to permit access to locking and pivoting system 28. The openings in frame wood cladding 42 clsely approximate the outer peripheral dimensions of locking and pivoting system 28 which is fixed directly onto interior surface 14 of frame 16. Grooves 52 are formed on the interior side 54 (the side adjacent the window) of body portion 48. Grooves 52 provide a more secure bond between frame wood cladding 42 and frame 16. Zigzag portion 56 is formed at the other end of body portion 48 and conforms to the inner peripheral surface of frame 16. The outer surface of zigzag portion 56 forms a screen recess which receives screens.

Figure 2:
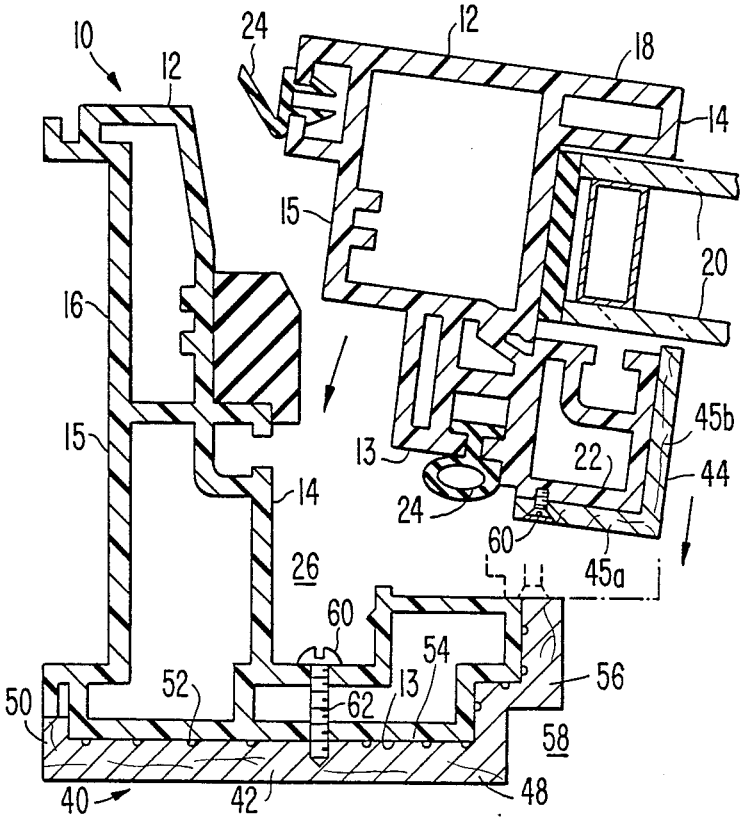
FIG. 2 is a sectional view of the wood clad window frame and sash taken along line 2—2 of FIG. 1.

As shown in FIGS. 2 and 4, sash wood cladding 44 has an L-shaped cross section shaped to fit on sash 18. Sash wood cladding 44 includes body portion **45*a* which is disposed on the inner surface of sash 18, and side portion 45*b*. Side portion 45*b* is perpendicular to body portion 45*a* and is disposed against the interior side surface of sash 18**.

Mullion wood cladding 46 is symmetrical as shown in FIG. 4. Mullion wood cladding 46 fits on mullions 34 disposed between windows and therefore has a cross section equivalent to doubling the half of the cross section of frame wood cladding 42 having zigzag portion 56. Thus, mullion wood cladding 46 includes body portion 48 having grooves 52 and zigzag portions 56 disposed at both ends of body portion 48. As mullions 34 are disposed between adjacent windows 10, zigzag portions 56 having screen recesses 58 on both sides are required. In both frame and mullion wood cladding, if screens are not required, such as where fixed picture windows are clad, zigzag portion 56 need not be formed with screen recesses 58.

Wood cladding may be fixed onto window 10 by adhesive. In the preferred embodiment, wood cladding 40 is further secured by screws 60 fastened from the inside out. That is, screws 60 are threaded through holes 62 formed through window 10 and into wood cladding 40. As shown in FIGS. 2 and 4, screws 60 mounting frame wood cladding 42 to frame 16 or mullion wood cladding 46 to mullions 34 are fastened totally through frame 16 or mullion 34 toward interior surface 14 of window 10. Screws 60 are threaded only partially into frame and mullion wood cladding 42, 46 so that the exterior surface of body portion 48 (facing the interior of the building) has a smooth, unmarred surface. The use of screws 60 enables the miter joint of perpendicular portions of frame and mullion wood cladding 42, 46 to be fine tuned and carefully adjusted before the adhesive sets.

Fastening sash wood cladding 44 to sash 18 is accomplished by screws 60 mounted from the outside in. Screws 60 are countersunk and may be covered by wood filler. Screws 60 are located in sash wood cladding 44 so that when sash 18 is closed, frame or mullion wood cladding 42, 46 cover screws 60, as shown in FIGS. 1 and 3. Alternatively, wood dowels may be inserted through sash wood cladding 44 and sash 18. Dowels may be painted, stained, and otherwise treated along with sash wood cladding 44 to provide an unmarred uniform surface finish for sash wood cladding 44.

Numerous characteristcs, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope of spirit of the invention.

I claim:

1. Wood cladding for mounting on the inner surface of nonwooden windows having common interior cross sections in which the sash is mounted on the frame from the outside of the window, the windows including a frame having a substantially planar inner surface with a screen recess disposable in the interior of a building, an outer surface opposite the inner surface and disposable on the exterior of the building, an exterior side surface between the inner and outer surfaces mountable inside a wall of the building, and an interior side surface between the inner and outer surfaces for receiving a sash, and a sash having a substantially planar inner surface disposable in the interior of the building, an outer surface opposite the inner surface and disposable on the exterior of the building, an exterior side surface between the inner and outer surfaces and receivable in the interior side surface of the frame, and an interior side surface between the inner and outer surfaces for receiving a pane of glass, said wood cladding comprising:

first and second sections of wood shaped to conform to the inner surface of the window, each said wood section having a uniform cross section along its entire length, being attachable to both the frame and the sash of the window without substantially altering the length and width dimensions of the window or affecting the fit of the window within a wall opening, said wood cladding providing an unmarred, unblemished wood appearance on the inner surface of the window;

said first wood section being mountable on the inner and interior side surfaces only of the frame of the window and having a uniform cross section conforming to the shape of the frame, said first wood section comprising a frame body portion disposed against the substantially planar inner surface of the window frame, a frame retaining lip disposed on one end of said frame body portion, said frame retaining lip being substantially perpendicular to said frame body portion and fitting around an outer peripheral edge of the substantially planar inner surface of the window frame, and a zig-zag portion disposed on the other end of said frame body portion and conforming to the screen recess formed on the substantially planar inner surface of the window frame, the outer surface portion of said frame zigzag portion being capable of receiving window screens;

said second wood section being mountable on the inner and interior side surfaces only of the sash of the window and having a uniform cross section conforming to the shape of the sash, said second wood section being L-shaped and comprising a sash body portion disposed against the substantially planar inner surface of the window sash, and a sash side portion disposed on one end of said sash body portion, said sash side portion being substantially perpendicular to said sash body portion and fitting against the interior side surface of the sash; and fastening means for fastening said wood first and second sections to the nonwooden window without being visible on the exterior of said wood sections.

2. Wood cladding as set forth in claim 1 wherein the sash of the window opens by pivoting outwardly around a vertical axis.

3. Wood cladding as set forth in claim 1 wherein the sash of the window opens by pivoting outwardly around a horizontal axis.

4. Wood cladding as set forth in claim 1 wherein the window is a fixed window.

5. Wood cladding as set forth in claim 1 wherein said wood cladding further comprises a third wood section for mounting on mullions of the window and having a uniform cross section conforming to the shape of the mullions wherein the mullions include a substantially planar inner surface having a screen recess at each end, said third wood section comprising a mullion body portion disposed against the substantially planar inner surface of the mullion and a mullion zigzag portion disposed on each end of said mullion body portion and conforming to the screen recess formed on the substantially planar inner surface of the mullion, said outer surface portion of said mullion zigzag portion being capable of receiving screens.

6. Wood cladding as set forth in claim 1 wherein said fastening means comprises an adhesive.

7. Wood cladding as set forth in claim 1 wherein said fastening means comprises wooden dowels disposed in holes formed in said wood cladding and the window wherein said dowels fasten said first wood section to the frame of the window and said second wood section to the sash of the window by passing totally through said first and second wood sections and into the respective frame and sash.

8. Wood cladding as set forth in claim 1 wherein said fastening means comprises screws threaded through holes formed in said wood cladding and the window wherein said screws fasten said first wood section to the frame of the window by passing totally through the substantially planar inner surface of the frame in a direction from the outer surface toward the substantially planar inner surface and partially through said first wood section so that said screws do not pass totally through said first wood section.

9. Wood cladding as set forth in claim 8 wherein the frame of the window is formed with a channel area within which a locking and pivoting system is housed, the locking and pivoting system pivotably opens and closes the sash and locks closed the sash, and said screws fastening said first wood section to the frame pass through the channel area.

10. Wood cladding as set forth in claim 8 wherein additional said screws fasten said second wood section to the sash of the window by passing totally through said second wood section and the substantially planar inner surface of the sash in a direction from the substantially planar inner surface toward the outer surface, said additional screws being disposed through said sash body portion of said second wood section adjacent the edge of said sash body portion closest to the exterior side surface of the sash so that when the sash is closed, said frame zigzag portion of said first wood section on the frame shields from view said additional screws.

11. Wood cladding as set forth in claim 8 wherein the ends of said wood sections to be mounted on the frame are beveled to form miter joints when said wood sections are mounted on the frame; and said fastening means is adjustable to loosen and tighten the fit of said wood cladding on the frame to adjust the alignment of said miter joint.

12. Wood cladding as set forth in claim 10 wherein said fastening means further comprises and adhesive and the inner surface of said wood sections comprises grooves, said grooves improving the adhesion between said wood sections and the window.

13. A window having common interior cross sections in which the sash is mounted on the frame from the outside of said window, said window comprising:

a nonwooden frame having a substantially planar inner surface with a screen recess disposable in the interior of a building, an outer surface opposite said inner surface and disposable on the exterior of the buiding, and exterior side surface between said inner and outer surfaces mountable inside a wall of the building, and an interior side surface between said inner and outer surfaces for receiving a sash;

a nonwooden sash having a substantially planar inner surface disposable in the interior of the building, an outer surface opposite said inner surface and disposable on the exterior of the building, an exterior side surface between said inner and outer surfaces and receivable in the interior side surface of said frame, and an interior side surface between said inner and outer surfaces for receiving a pane of glass;

wood cladding mounted on said inner surfaces of both said frame and said sash without substantially altering the length and width dimensions of said window or affecting the fit of said window within the wall opening, said wood cladding comprising first and second sections of wood shaped to conform to the interior surfaces of said frame and said sash, each said wood section having a uniform cross section along its entire length, said wood cladding providing an unmarred, unblemished wood appearance on the inner surface of said window;

said first wood section being mountable on said inner and interior side surfaces only of said frame of said window and having a uniform cross section conforming to the shape of said frame, said first wood section comprising a frame body portion disposed against said substantially planar inner surface of said window frame, a frame retaining lip disposed on one end of said frame body portion, said frame retaining lip being substantially perpendicular to said frame body portion and fitting around an outer peripheral edge of said substantially planar inner surface of said window frame, and a frame zigzag portion disposed on the other end of said frame body portion and conforming to the screen recess formed on said substantially planar inner surface of said window frame, said outer surface portion of said frame zigzag portion being capable of receiving window screens;

said second wood section being mountable on said inner and interior side surfaces only of said window and having a uniform cross section conforming to the shape of said sash, said second wood section being L-shaped and comprising a sash body portion disposed against said substantially planar inner surface of said window sash, and a sash side portion disposed on one end of said sash body portion, said sash side portion being substantially perpendicular to said sash body portion and fitting against said interior side surface of said sash; and fastening means for fastening said wood sections to said window without being visible on the exterior of said wood sections.

14. A window as set forth in claim 13 further comprising pivoting means for outwardly opening said nonwooden sash with respect to said frame and for closing said sash, wherein said wood cladding does not interfere with or alter the operating characteristics of said window.

15. A window as set forth in claim 14 wherein said sash of said window opens by pivoting outwardly around a vertical axis.

16. A window as set forth in claim 14 wherein said sash of said window opens by pivoting outwardly around a horizontal axis.

17. A window as set forth in claim 14 further comprising mullions, wherein said wood cladding further comprises a third wood section for mounting on said a mullions of said window and having a uniform cross section conforming to the shape of said mullions wherein said mullions include a substantially planar inner surface having a screen recess at each end, said third wood section comprising a mullion body portion disposed against said substantially planar inner surface of said mullion and a mullion zigzag portion disposed on each end of said mullion body portion and conforming to the screen recess formed on the substantially planar inner surface of said mullion, said outer surface portion of said mullion zigzag portion being capable of receiving screens.

18. A window as set forth in claim 14 wherein said fastening means comprises an adhesive.

19. A window as set forth in claim 14 wherein said fastening means comprises wooden dowels disposed in holes formed in said wood cladding and said window wherein said dowels fasten said first wood section to said frame of said window and said second wood section to said sash of said wondow by passing totally through said first and second wood sections and into said respective frame and sash.

20. A window as set forth in claim 14 wherein said fastening means comprises screws threaded through holes formed in said wood cladding and said window wherein said screws fasten said first wood section to said frame of said window by passing totally through said substantially planar inner surface of said frame in a direction from said outer surface toward said substantially planar inner surface and partially through said first wood section so that said screws do not pass totally through said first wood section.

21. A window as set forth in claim 20 wherein said frame of said window is formed with a channel area within which a locking and pivoting system is housable, said locking and pivoting system pivotably opens and closes said sash and locks closed said sash, and said screws fastening said first wood section to said frame pass through said channel area.

22. A window as set forth in claim 20 wherein additional said screws fasten said second wood section to said sash of said window by passing totally through said second wood section and said substantially planar inner surface of said sash in a direction from said substantially planar inner surface toward said outer surface, said additional screws being disposed through said sash body portion of said second wood section adjacent the edge of said sash body portion closest to said exterior side surface of said sash so that when said sash is closed, said frame zigzag portion of said first wood section on said frame shields from view said additional screws.

23. A window as set forth in claim 20 wherein the ends of said wood sections to be mounted on said frame are beveled to form miter joints when said wood sections are mounted on said frame; and said fastening means is adjustable to loosen and tighten the fit of said wood cladding on said frame to adjust the alignment of said miter joint.

24. A window as set forth in claim 20 wherein said fastening means further comprises an adhesive and the inner surface of said wood sections comprises grooves, said grooves improving the adhesion between said wood sections and said window.

25. A window as set forth in claim 13 wherein said sash is fixed to said frame.

* * * * *